US005876034A

United States Patent [19]

Stafford

[11] Patent Number: 5,876,034

[45] Date of Patent: Mar. 2, 1999

[54] SPORTING FISHING BOARD GAME

[76] Inventor: James R. Stafford, 801 Airport Heights Rd. # 38, Anch, Ak. 99508

[21] Appl. No.: 992,043

[22] Filed: Dec. 17, 1997

[51] Int. Cl.[6] ..... A63F 3/00

[52] U.S. Cl. ..... 273/244

[58] Field of Search ..... 273/244, 277, 273/243, 242, 248, 249

[56] References Cited

U.S. PATENT DOCUMENTS

| | | | |
|---|---|---|---|
| 3,888,489 | 6/1975 | Kane | 273/244 |
| 3,921,981 | 11/1975 | Ashburn | 273/244 |
| 4,003,578 | 1/1977 | Jones | 273/244 |
| 5,176,385 | 1/1993 | Tagliaferro | 273/244 |
| 5,186,466 | 2/1993 | Mudd et al. | 273/244 |
| 5,513,848 | 5/1996 | Keener | 273/244 |

*Primary Examiner*—William E. Stoll
*Attorney, Agent, or Firm*—Michael J. Tavella

[57] ABSTRACT

A fishing board game that is designed to be carried in a fishing tackle box style container. The lower portion of the box holds the board, score pads, instructions and bag limits. The upper portion of the box has a tray similar to those found in regular tackle boxes. The tray has six compartments to hold the playing cards, game tokens and die. The game board covers a wide portion of south-central Alaska. This area provides a wide variety of fishing choices and opportunities. Players move around the board, using a die to count spaces. Spaces include fish-on spaces, fly-in fishing spaces, float trip spaces and chance spaces. Players move around the board, catching fish and attempting to avoid trouble. There are several options for scoring and for the type of fishing that can be performed. At the end of the game, the player with the most points wins.

8 Claims, 15 Drawing Sheets

Fish On Cards

| Speces | Size (lbs) | Points | Number of Cards |
|---|---|---|---|
| Halibut | 25# | 10 | 4 |
| | 40# | 15 | 4 |
| | 70# | 20 | 4 |
| | 95# | 25 | 4 |
| | 110# | 30 | 2 |
| | 130# | 35 | 2 |
| | 150# | 40 | 2 |
| | 210# | 45 | 2 |
| | 265# | 50 | 1 |
| | 345# | 75 | 1 |
| Ling Cod | 30# | 10 | 4 |
| | 40 | 15 | 4 |
| | 50 | 20 | 2 |
| | 65 | 25 | 1 |
| | 78 | 50 | 1 |
| Snapper | 5 | 5 | 4 |
| | 10 | 10 | 4 |
| | 15 | 15 | 2 |
| | 25 | 20 | 2 |
| | 30 | 25 | 2 |
| Rock Fish | 5 | 5 | 4 |
| | 10 | 10 | 4 |
| Sea Bass | 5 | 5 | 2 |
| | 8 | 10 | 2 |
| | 12 | 15 | 2 |
| Wolf Eel | 25 | 15 | 2 |
| | 35 | 20 | 1 |

Figure 11a

Fish On Cards Continued

| Speces | Size (lbs) | Points | Number of cards |
|---|---|---|---|
| Shark | 500 | 50 | 1 |
| | 650 | 75 | 1 |
| Green Ling | 3 | 2 | 6 |
| Grey Cod | 15 | 1 | 4 |
| | 25 | 3 | 4 |
| King Salmon | 30 | 10 | 4 |
| | 35 | 15 | 4 |
| | 45 | 20 | 2 |
| | 65 | 25 | 2 |
| Silver Salmon | 10 | 5 | 4 |
| | 12 | 10 | 4 |
| | 16 | 15 | 2 |
| | 19 | 20 | 2 |
| Irish Lord | 5 | -5 | 4 |
| | 10 | -15 | 1 |
| | 5 | -20 | 1 |

Fish On Problem Cards

| Problem | Minus Point Value | Number of Cards |
|---|---|---|
| sea weed | -5 | 5 |
| snagged (on bottom) | -10 | 5 |
| Slack (in line) | -15 | 5 |
| Tangle (in reel) | -20 | 5 |
| Drag too tight | -25 | 5 |

Figure 11b

Fly-In Cards

| Speces | Size (lbs) | Points | Number of cards |
|---|---|---|---|
| Northern Pike | 15# | 10 | 5 |
| | 20 | 15 | 3 |
| | 25 | 20 | 3 |
| | 30 | 25 | 2 |
| | 38 | 50 | 1 |
| Rainbow Trout | 12 | 15 | 5 |
| | 17 | 20 | 3 |
| | 24 | 35 | 1 |
| Arctic Grayling | 2 | 10 | 4 |
| | 4 | 25 | 1 |
| Arctic Char | 10 | 10 | 5 |
| | 14 | 15 | 3 |
| | 17 | 25 | 3 |
| King Salmon | 47 | 25 | 6 |
| | 59 | 30 | 3 |
| | 68 | 40 | 1 |
| Steelhead | 18 | 20 | 2 |
| | 26 | 30 | 2 |
| | 34 | 50 | 1 |
| Lake Trout | 24 | 20 | 2 |
| | 38 | 40 | 2 |
| | 46 | 75 | 1 |

Fly-In Problem Cards

| Problem | Minus Point Value | Number of Cards |
|---|---|---|
| Sea weed | -5 | 2 |
| Snagged (on bottom) | -10 | 2 |
| Slack (in line) | -15 | 2 |
| Tangle (in reel) | -20 | 2 |
| Drag too tight | -25 | 2 |
| Spawned salmon | -20 | 6 |

Figure 12

Float Trip Cards

| Species | Size (lbs) | Points | Number of Cards |
|---|---|---|---|
| King Salmon | 50 | 50 | 5 |
| | 65 | 55 | 4 |
| | 70 | 60 | 2 |
| | 86 | 75 | 1 |
| Silver Salmon | 19 | 10 | 6 |
| | 24 | 25 | 4 |
| | 26 | 30 | 2 |
| Red Salmon | 9 | 10 | 6 |
| | 12 | 20 | 4 |
| | 14 | 30 | 2 |
| Rainbow Trout | 8 | 10 | 6 |
| | 12 | 15 | 4 |
| | 15 | 20 | 2 |
| Dolly Varden | 5 | 10 | 6 |
| | 10 | 15 | 4 |
| | 12 | 20 | 2 |

Float Trip Problem Cards

| Problem | Minus Point Value | Number of Cards |
|---|---|---|
| Sea weed | -5 | 2 |
| Snagged (on bottom) | -10 | 2 |
| Slack (in line) | -15 | 2 |
| Tangle (in reel) | -20 | 2 |
| Drag too tight | -25 | 2 |
| Spawned salmon | -20 | 6 |

Figure 13

Point-Spaces Cards

| Points | Spaces | Number of Cards |
|---|---|---|
| 5 | 1 | 4 |
| 5 | 4 | 4 |
| 5 | 3 | 4 |
| 10 | 1 | 4 |
| 10 | 2 | 4 |
| 10 | 4 | 4 |
| 15 | 2 | 4 |
| 15 | 3 | 4 |
| 15 | 3 | 4 |
| 20 | 1 | 4 |
| 20 | 2 | 4 |
| 20 | 3 | 4 |
| 30 | 2 | 4 |
| 30 | 4 | 4 |
| 30 | 1 | 4 |
| 40 | 3 | 8 |
| 50 | 1 | 2 |

Figure 14

Daily Bag Limits and State Records

| Species | Record Weight (pounds) | Daily Bag Limit Fresh Water/Salt Water | | |
|---|---|---|---|---|
| King Salmon | 97.4 | 1 | / | 2 |
| Silver Salmon | 26.0 | 3 | / | 6 |
| Red Salmon | 16.0 | 3 | / | 6 |
| Rainbow Trout | 42.3 | 1 | / | N/L |
| Dolly Varden | 19.8 | 5 | / | 10 |
| Grayling | 4.8 | 10 | / | N/L |
| Steelhead | 42.3 | 1 | / | N/L |
| Ling Cod | 79.0 | N/L | / | 2 |
| Halibut | 440.0 | N/L | / | 2 |
| Red Snapper | 35.0 | N/L | / | 5 |
| Northern Pike | 38.8 | 10 | / | N/L |
| Arctic Char | 19.2 | 5 | / | 5 |
| Lake Trout | 47.0 | 2 | / | N/L |
| Burbot | 24.9 | 5 | / | N/L |
| Sea Bass | 22.3 | N/L | / | 5 |
| Rock Fish | 26 | N/L | / | 5 |
| Wolf Eel | None | N/L | / | N/L |
| Salmon Shark | None | N/L | / | N/I |

N/L = No limit or Not listed/Not Applicable

Figure 15

SPORTING FISHING BOARD GAME

BACKGROUND OF THE INVENTION

Sport fishing is a growing activity. People are spending billions of dollars every year to catch fish, both on saltwater and on fresh water lakes and streams. Unfortunately, most people are limited in their access to fishing sites. To aid in their enjoyment of this sport, fishing type board games have been developed. These games attempt to give the player a sense of the pleasure of real fishing.

BRIEF SUMMARY OF THE INVENTION

The instant invention is a fishing board game. This game has several unique features. First, the game is designed to be carried in a fishing tackle box style container. The lower portion of the box holds the board, score pads, instructions and bag limits. The upper portion of the box has a tray similar to those found in regular tackle boxes. The tray has six compartments to hold the playing cards, game tokens and die.

The game board covers a wide portion of south-central Alaska. This area provides a wide variety of fishing choices and opportunities: from salt water to fresh water from large king salmon and halibut to dolly varden and trout. This variety provides players a wide range of options and creates the ability of experiencing a different game every time the game is played.

Players move around the board, using die to count spaces. There are several types of spaces on the board. These spaces include fish-on spaces, fly-in fishing spaces, float trip spaces and chance spaces. Players move around the board, catching fish and attempting to avoid trouble. There are several options for scoring and for the type of fishing that can be performed. For example, players can play "catch and release" or play a biggest fish derby. Players also can be penalized if they are over the bag limits for fish as established in the rules. Players can also lose points by chance or by running into trouble (either on selected spaces or through bad luck cards). The players play for one game day (two times around the board, for example) and at the end of the "day" (or other desired period). the player with the most points wins.

BRIEF DESCRIPTION OF THE DRAWINGS

FIG. 11*a* is a table describing the Fish on cards provided in the game.

FIG. 11*b* is a continuation of the table of Fish On cards.

FIG. 12 is a table describing the Fly-in cards provided in the game.

FIG. 13 is a table describing the Float trip cards provided in the game.

FIG. 14 is a table describing the Point Space cards provided in the game.

FIG. 15 is a table listing the record weight and daily bag limits for sport fishing species of Alaska.

DETAILED DESCRIPTION OF THE INVENTION

Figure 1:
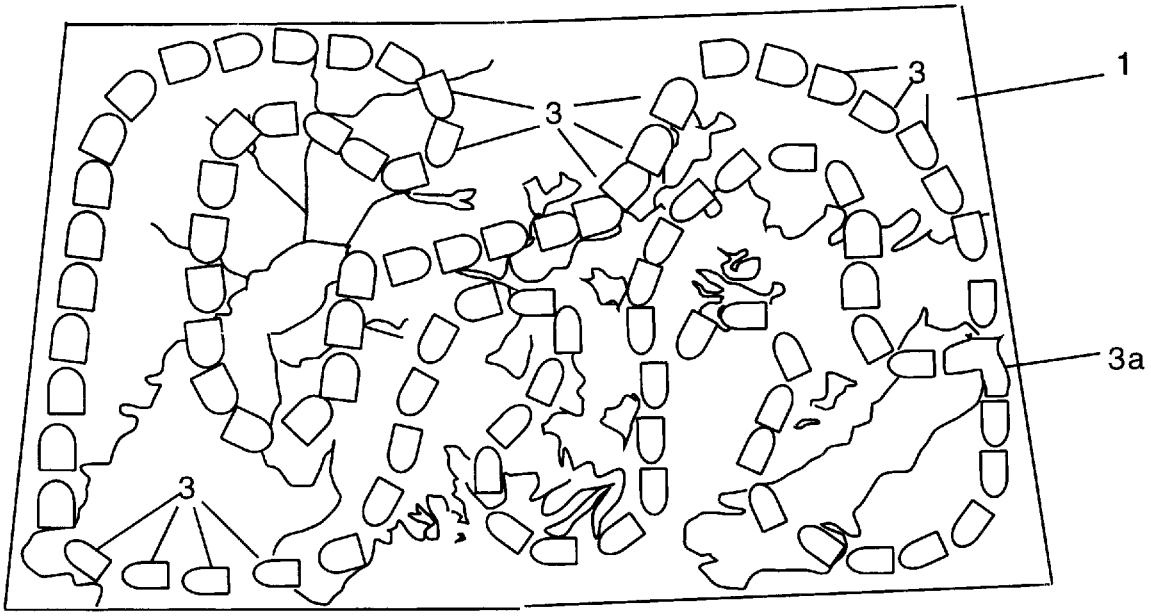
FIG. 1 is top view of the game board.
Figure 2:
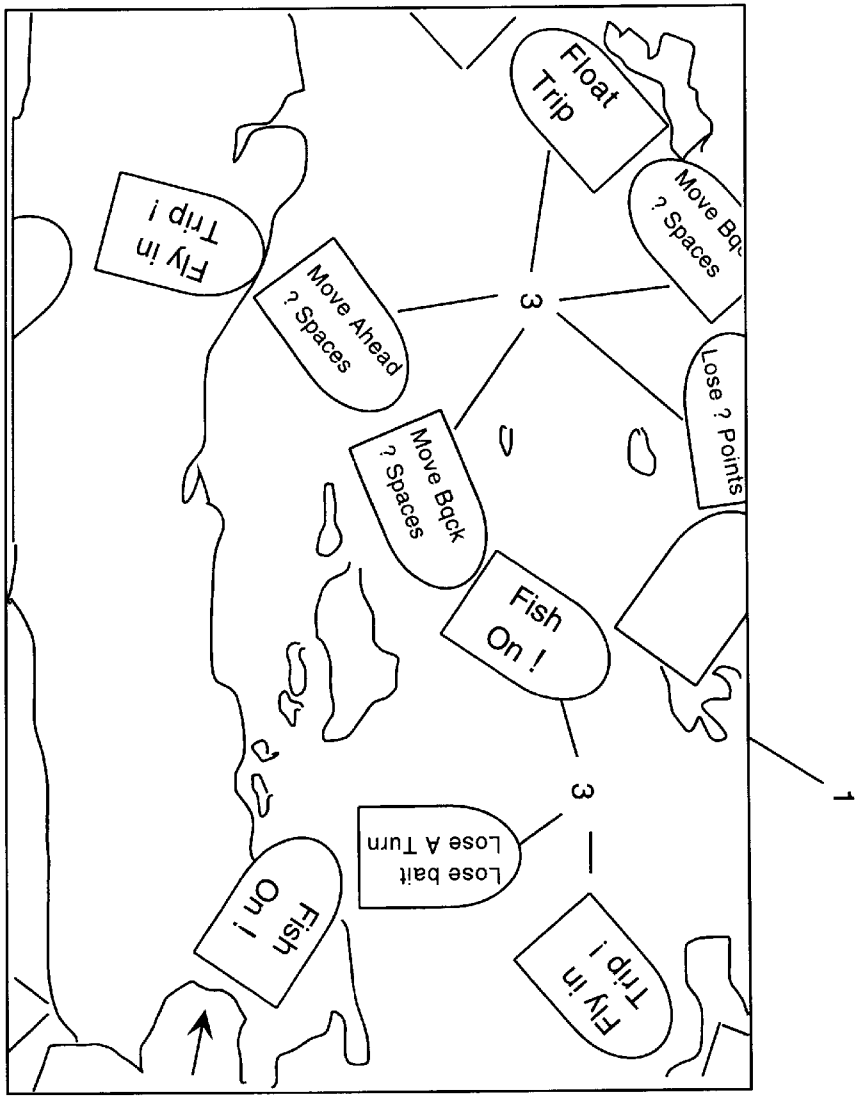
FIG. 2 is a detail view of a portion of the game board.
Figure 3:
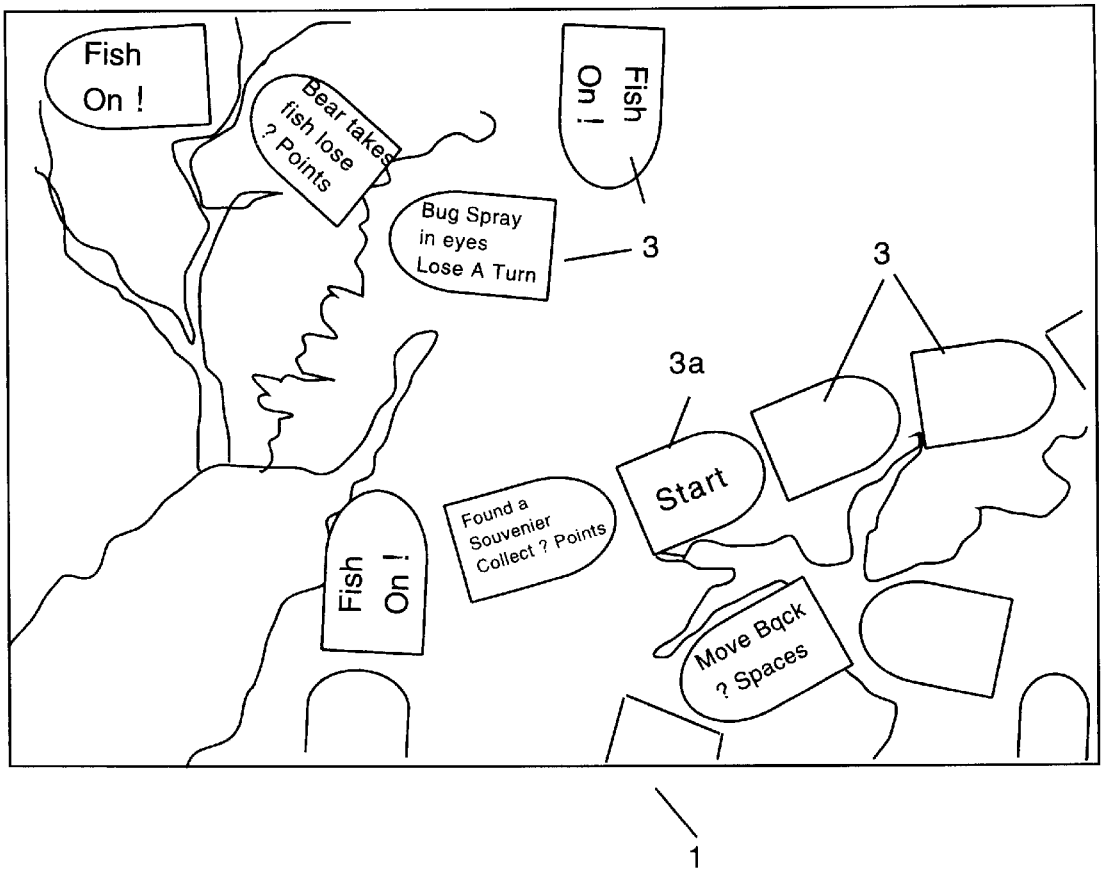
FIG. 3 is a detail view of another section of the game board.

Referring now to FIGS. 1, 2 and 3 and 8, the game board 1 is shown. In the preferred embodiment, the game board 1 is 18 inches by 24 inches. The background of the board is an abstract aerial view of a region of South Central Alaska. This area provides both salt water and fresh water fishing experiences. Key towns are identified on the board. In the preferred embodiment, 95 spaces 3 are placed over the background in a pattern as shown in FIG. 1. The game starts in a town called Whitter and ends in Anchorage. Of the 95 spaces, there are 7 "fly-in" spaces, 6 "float-trip" spaces, 22 "Fish-on" spaces, 8 "move-back" spaces, 3 "move ahead" spaces, 32 blank spaces, one start space and 1 collect points space. Of course, the exact number and placement of spaces 3 can vary, but the proportions of spaces should remain the same in that this mix of spaces provides a continuous level of activity that keeps the game interesting. FIGS. 2 and 3 are details of portions of the board 1 showing details of the specific spaces 3. As noted above, the exact placement of all types of spaces can be varied. FIG. 1 also shows that some spaces 3*a* allow a choice to be made as to the proper path. This allows players to change the route of the game each time it is played, which also increases interest.

Figure 8:
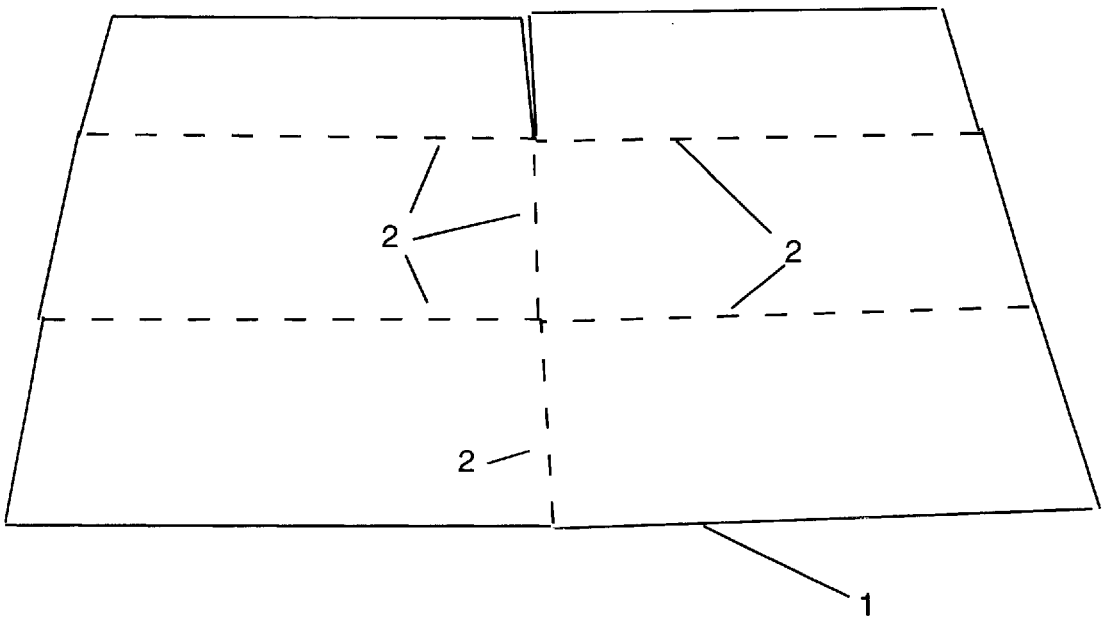
FIG. 8 is a back view of the game board, showing the break lines for folding.

FIG. 8 shows the back of the game board 1. The game board 1 is scored along lines 2 so that it can be folded for storage. The game is designed to be stored in a fishing tackle style box, as discussed below.

Figure 9:
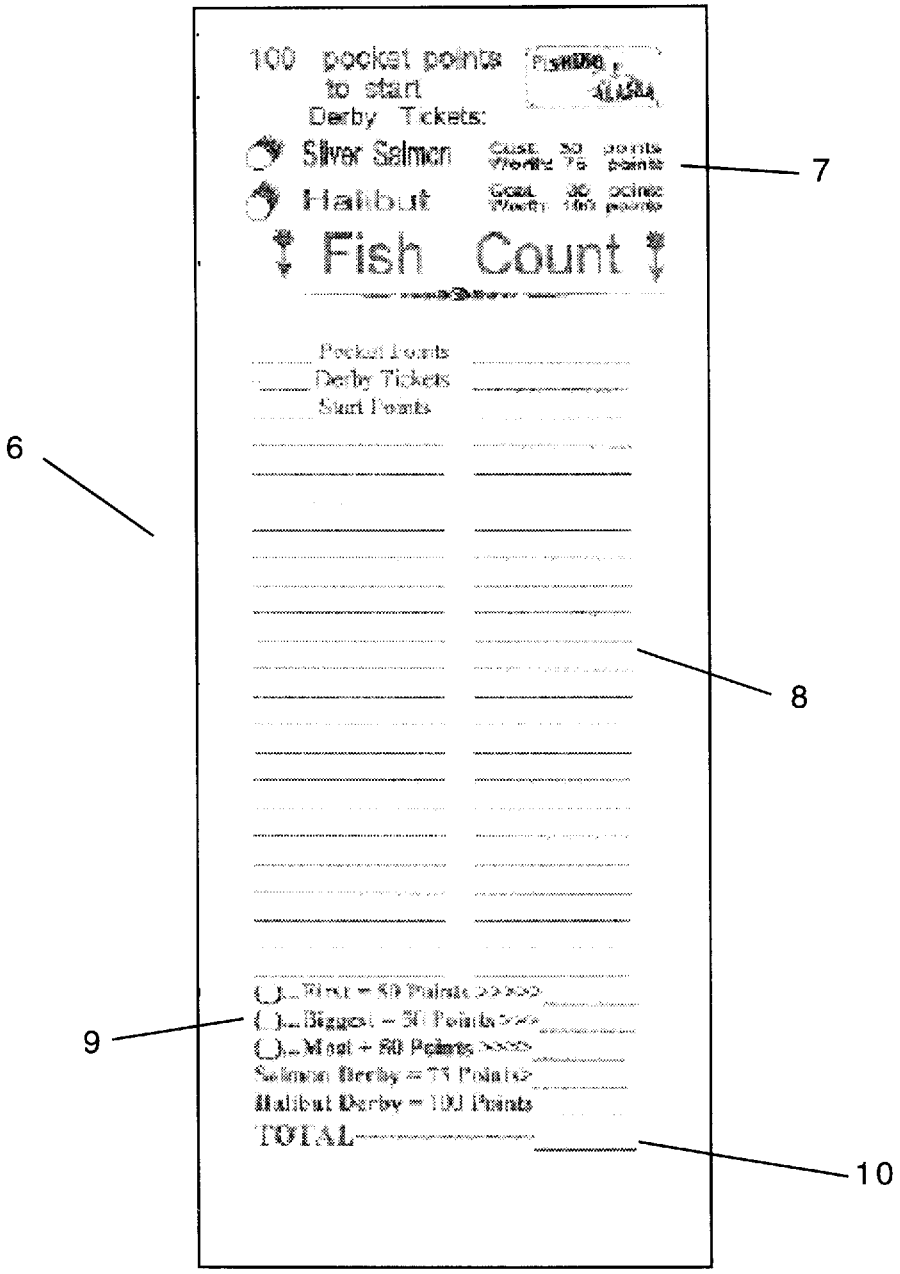
FIG. 9 is a top view of a typical score sheet.
Figure 16:
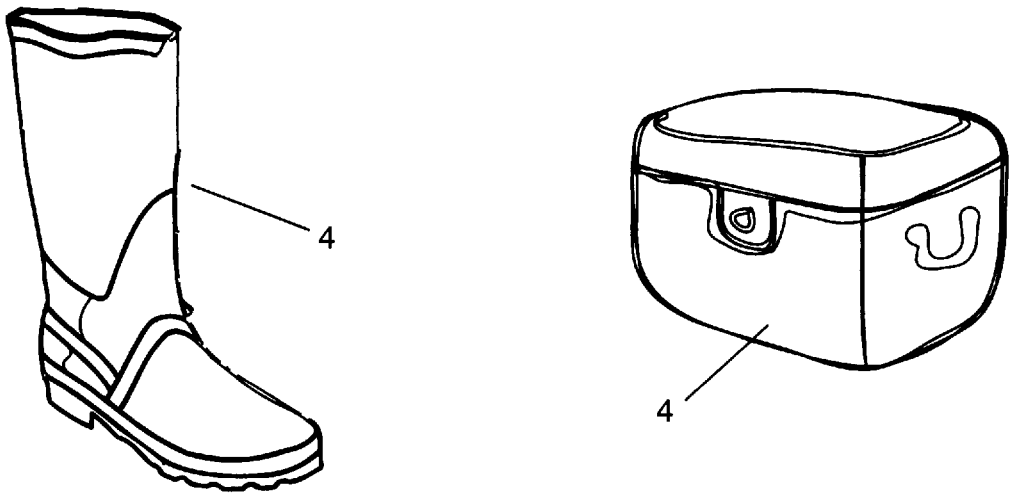
FIG. 16 is a detail view of typical game tokens.
Figure 17:
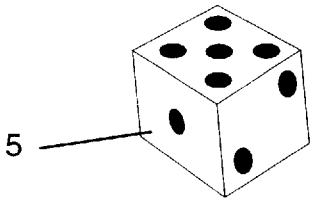
FIG. 17 is a detail view of a die space counter.

Besides the game board, several other items are needed to play the game. These include a set of tokens 4 (one token represents one player). The tokens can be of any type, but are preferably related to fishing. These could include small boats, ice chests, hip boots, etc. FIG. 16 shows typical tokens. At least one standard die 5 is needed to count space movement. The die is shown in FIG. 17. Score pads 6 are also needed. FIG. 9 shows a typical score sheet 6. The sheets have a space 7 at the top to record "purchase" of derby tickets, as discussed below. The sheets then have a space to record the fish count and points scored 8. The sheets also have a space to record bonus points 9 for various categories as shown, and to total all points 10.

A table is provided that shows daily bag limits (number of fish) in both fresh water and salt water for each species of fish included in the game. The preferred embodiment also includes information on the record fish for each species. This table is shown in FIG. 15.

Figure 4A:
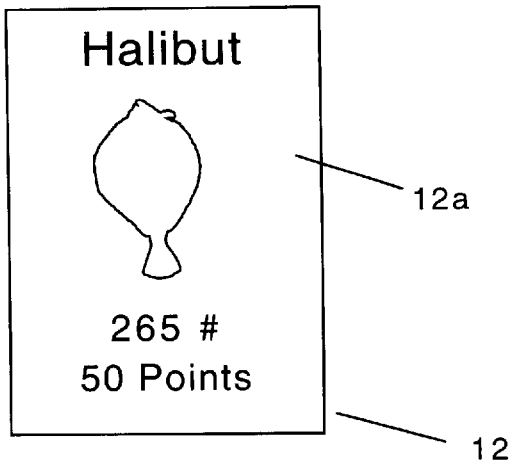
FIG. 4*a* is a top view of the face of a typical fish-on game card.
Figure 4B:
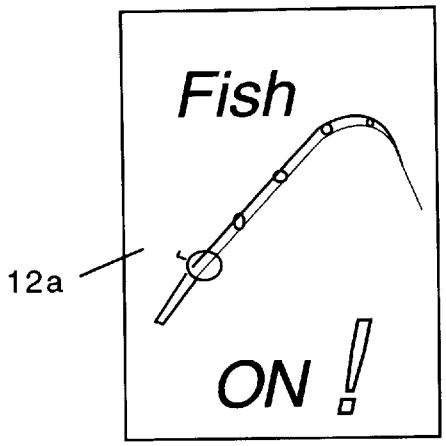
FIG. 4*b* is a top view of the back of a typical fish-on card.

There are four different groups of game cards 12. There are "Fish On" cards 12*a* (FIGS. 4*a* and 4*b*), Question cards

Figure 5A:
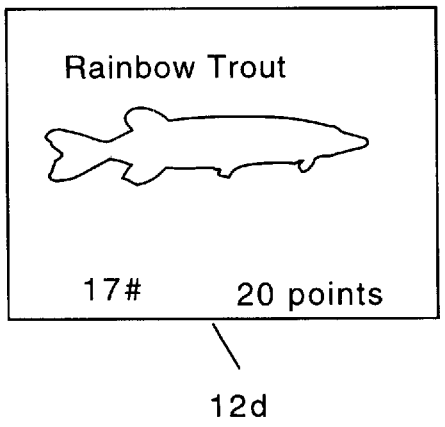
FIG. 5*a* is a top view of the face of a typical Fly-in card.
Figure 5B:
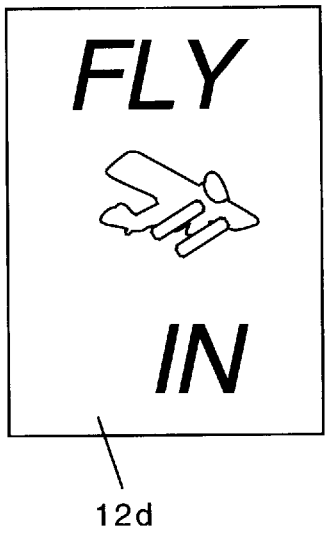
FIG. 5*b* is a top view of the back of a typical Fly-in card.
Figure 6A:
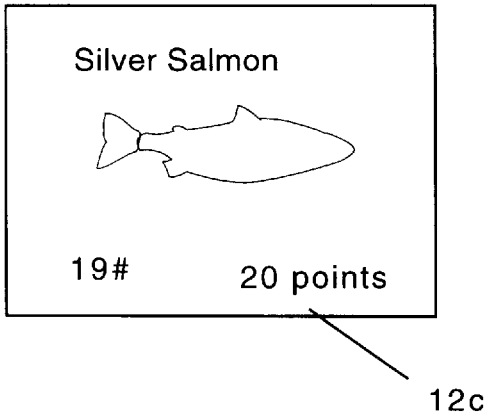
FIG. 6*a* is a top view of the face of a typical Float-trip card.
Figure 6B:
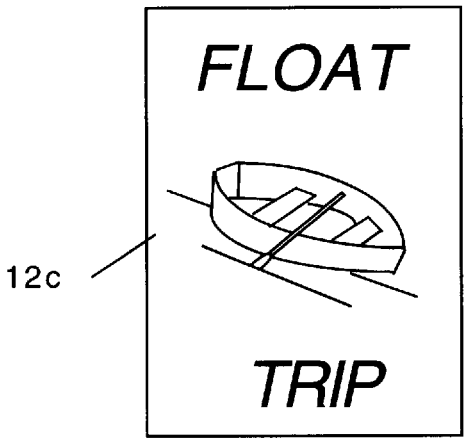
FIG. 6*b* is a top view of the back of a typical Float-trip card.
Figure 7A:
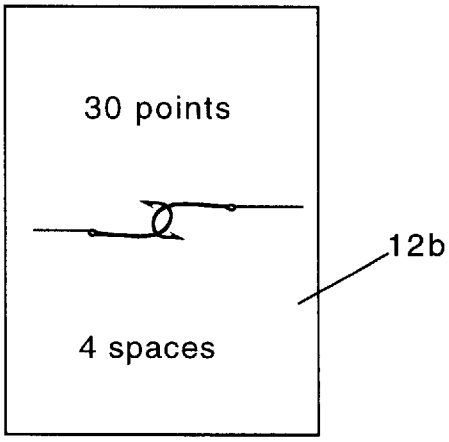
FIG. 7*a* is a top view of the face of a typical Question card.
Figure 7B:
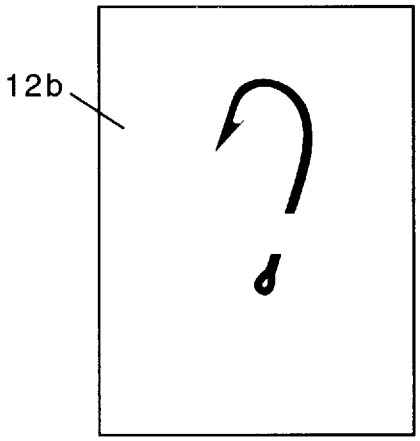
FIG. 7*b* is a top view of the back of a typical Question card.

12*b* (FIGS. 7*a* and 7*b*) (identified by a "?" symbol that resembles a fish hook on their backs), "Float trip" cards 12*c* (FIGS. 6*a* and 6*b*), and "Fly-in" cards 12*d* (FIGS. 5*a* and 5*b*). In the preferred embodiment, there are 140 Fish On cards, 70 Question cards, 75 Float trip and 75 Fly-in cards. These cards are placed face down in five stacks on the board (the fish on cards are divided into two stacks for convenience).

Each group of cards 12, except for the question cards, includes a number of problem cards. The 140 Fish on cards include 25 problem cards, and both the Fly-in and float trip cards have 10 problem cards each.

FIGS. 11*a* and 11*b* are tables that show the contents of the "Fish on" cards 12*a* by species, weights, point value and the number of cards in the deck.

FIG. 12 shows the contents of "Fly-in" cards 12*b* by species, weights, point value and the number of cards in the deck.

FIG. 13 shows the contents of "Float trip" cards 12*c* by species, weights, point value and the number of cards in the deck.

The question cards 12*d* (identified by an upside down fish hook to like a "?") serve a dual purpose. These cards have a point count and a space count. When you land on a "?" space, the space will tell you to either add or subtract a "?" number of points or to move back or forward "?" spaces. See, e.g., FIG. 7*a* The point count or space count provides the amount of points or spaces to move. The contents of these cards is shown in FIG. 14.

FIGS. 4*b*, 5*b*, 6*b*, and 7*b* show the back of the cards 12*a*, 12*b*, 12*c*, and 12*d*, as indicated above. The four types of cards can also have different colors to differentiate them further. The colors also provide a convenient way of separating kept fish by type, e.g., either salt water or fresh water. This is important when keeping track of bag limits for species that are both salt water and fresh water species. A player can catch the limit of a species in both fresh water and salt water. Having different colors for salt water and fresh water helps keep better track of the bag limits. FIG. 15 shows a list of the major game fish species in Alaska, the record for each fish and the daily bag limits for each fish. Players use this chart to ensure that bag limits are being followed, as required by the rules of the game.

Playing the Game

Each player gets 100 points at the start. Before the game begins, player must decide if they wish to participate in fishing derbys. If so, they must "purchase" a derby ticket for each derby they enter. In the preferred embodiment, the Silver Salmon derby tickets cost 30 points for one day and the Halibut derby costs 35 points for one day. The game is set up so that two circuits around the board constitutes one fishing day. Accordingly, for games lasting more than one fishing day, additional derby tickets must be purchased as needed.

Each player begins on the start space 3*b*. Players can choice who goes first by a roll of the die 5, with the highest number going first. Players move clockwise around the board 1. Players move around the board by rolling the die 5 and moving their token 4 the number of spaces shown. A player landing on a "?" space, a "fish on" space, a "float trip" space or a "fly-in" space draws the appropriate card from the stack and follows the directions. For a "?" space, the space tells the player what happens, the "?" card tells the player how many points or spaces to gain or lose. Fish caught can be thrown back if the limit for that species is reached or the fish is not large enough. Under the standard play rules, the point value of the fish is recorded on the score sheets, whether the fish is kept or not. However, only those fish kept determine the bonus points for the first fish, the biggest fish and the most fish.

For those players who have entered a fishing derby by buying a derby ticket, the player holding the largest species related to the derby receives bonus points. In the preferred embodiment, the player holding the winning silver salmon receives 75 bonus points. The player winning the Halibut derby receives 100 bonus points.

In the standard play, a player must pay attention to bag limits. Any player that catches another player over the limit for a species gets 50 points that are then subtracted from the over limit player's score.

Play thus continues until the end of the fishing day, or until the number of agreed-upon fishing days is completed. At that point, the point totals are accumulated and the player with the highest point total wins.

Of course, play can be varied to suit the desires of the players. The derbys may be dropped, or play can focus exclusively on the derbys. A game variation that consists of only counting the retained fish can be played. Obviously, the variations are extensive.

Figure 10:
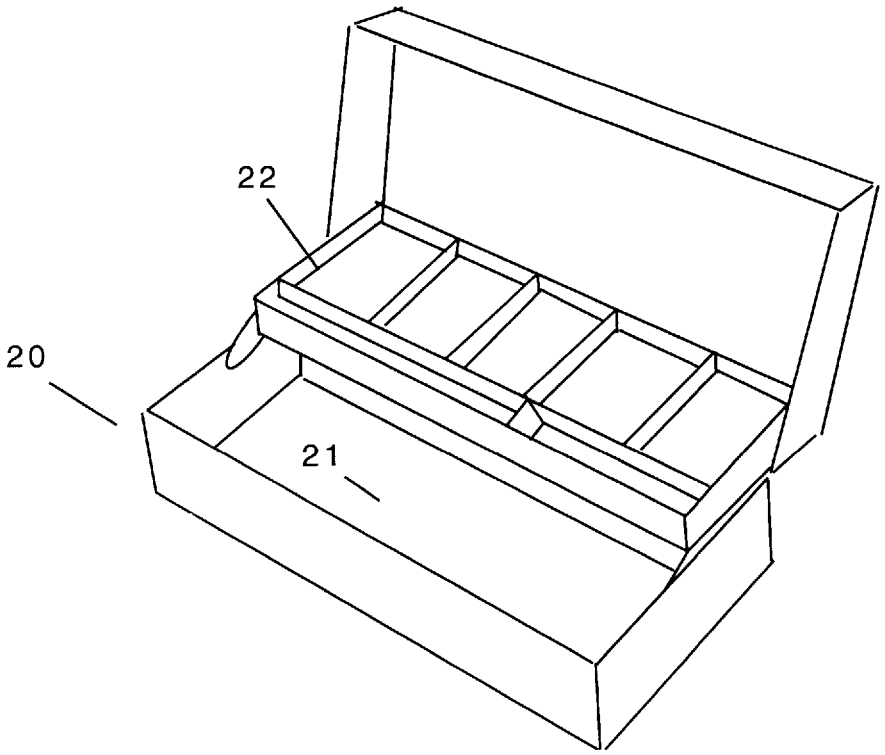
FIG. 10 is a perspective view of the game storage box.

Another unique aspect of the game is that it is stored in a fishing tackle type box 20 when not in use. An example of this type of box is shown in FIG. 10. The box 20 has a lower storage area 21 for the game board and score sheets, and an upper tray 22 that holds the game cards 12, tokens 4 and the die 5.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A fishing board game comprising:

a) a foldable board, said board having a number of spaces printed thereon, corresponding to a path through a geographic location;

b) a plurality of game pieces, such that one game piece corresponds to one player;

c) a means of designating a space count for movement;

d) a first set of game cards, each card in said first set of game cards having a listing describing a salt water species of fish, a given weight for that fish, and a point value;

e) a second set of game cards, each card in said second set of game cards having a listing describing a fresh water species of fish, a given weight for that fish, and a point value;

f) a third set of game cards, each card in said third set of game cards having a listing describing a fresh water species of fish, a given weight for that fish, and a point value;

g) a fourth set of game cards, each card in said fourth set of game cards having a listing describing a specific point value, and a specific number of spaces; and h) a means for keeping score.

2. The fishing board game of claim 1 wherein said first set of game cards further includes a set of problem cards, wherein each card in said set of problem cards contains a description of a problem, and a negative point value.

3. The fishing board game of claim 1 wherein said second set of game cards further includes a set of problem cards, wherein each card in said set of problem cards contains a description of a problem, and a negative point value.

4. The fishing board game of claim 1 wherein said third set of game cards further includes a set of problem cards, wherein each card in said set of problem cards contains a description of a problem, and a negative point value.

5. The fishing board game of claim 1 wherein the means of designating a space count for movement is a die.

6. The fishing board game of claim 1 wherein the means of keeping score comprises a score sheet.

7. The fishing board game of claim 1 further comprising a storage box.

8. The fishing board game of claim 7 wherein the storage box has an inner storage compartment that includes a tray having a plurality of compartments formed therein.

* * * * *